US008371392B2

(12) United States Patent
Ba-abbad

(10) Patent No.: US 8,371,392 B2
(45) Date of Patent: Feb. 12, 2013

(54) FIRE EXTINGUISHING APPARATUS

(75) Inventor: Mazen A. Ba-abbad, Riyadh (SA)

(73) Assignee: King Abdul Aziz City for Science and Technology (KACST), Riyadh (SA)

( * ) Notice: Subject to any disclaimer, the term of this patent is extended or adjusted under 35 U.S.C. 154(b) by 218 days.

(21) Appl. No.: 12/912,749

(22) Filed: Oct. 27, 2010

(65) Prior Publication Data

US 2012/0103636 A1 May 3, 2012

(51) Int. Cl.
*A62C 25/00* (2006.01)

(52) U.S. Cl. ..... 169/53; 169/13; 169/16; 169/54; 169/70; 239/171; 239/251; 239/536; 239/588

(58) Field of Classification Search ..... 169/16, 169/37, 52–54, 13, 70; 239/171, 251, 253, 239/536, 548, 556, 588; 244/136
See application file for complete search history.

(56) References Cited

U.S. PATENT DOCUMENTS 2,779,421 A * 1/1957 Rust ..... 169/53
3,580,339 A * 5/1971 Nance ..... 169/53
6,889,776 B2 * 5/2005 Cheung ..... 169/53

* cited by examiner

*Primary Examiner* — Steven J Ganey
(74) *Attorney, Agent, or Firm* — Timberline Patent Law Group PLLC; Mark Farrell

(57) ABSTRACT

The invention provides a fire extinguishing apparatus. The fire extinguishing apparatus includes a holding unit for holding various components of the fire extinguishing apparatus. The fire extinguishing apparatus also includes one or more tubes which are operatively coupled to the holding unit. The one or more tubes are capable of rotating with respect to the holding unit, such that an axis of rotation of a tube is angled at a predetermined angle to the earth surface. Further, each tube of the one or more tubes includes one or more nozzles for dispersing a fire extinguishing fluid to a location of the fire. The fire extinguishing fluid is supplied to the one or more tubes through a fluid supplying unit. The fluid supplying unit and the one or more tubes are held together by the holding unit in a suspended manner above the location of the fire.

19 Claims, 2 Drawing Sheets

FIRE EXTINGUISHING APPARATUS

FIELD OF THE INVENTION

The present invention generally relates to a fire extinguishing apparatus, and more specifically, to an over head fire extinguishing apparatus for extinguishing fire spread in large areas.

BACKGROUND OF THE INVENTION

Presently, various types of small and large fire extinguishing devices are used for combating on the spot fire. In cases where the fire is spread across large areas, such as forest fire and brush fire, large equipments and infrastructures are used for extinguishing the fire. These equipments include large tankers, pumps, vehicles for mounting the fire extinguishing devices, and so forth. Generally, cost associated with these equipments is high and these equipments require a long time for retarding the fire. Further, lot of manpower is required for managing these equipments.

At times, these equipments are mounted over aircrafts or suspended from the aircrafts, such as helicopter to provide aerial dispersion of the fire extinguishing fluid above location of the fire. However, such equipments do not efficiently disperse the fire extinguishing fluid and thus results in wastage of the fire extinguishing fluid. Further, these equipments mounted over or suspended from the aircrafts may be heavy and thus may be difficult to manage.

Therefore, there is a need for a fire extinguishing apparatus which can be efficiently used in overcoming fire spread over large areas. Further, there is a need of the fire extinguishing apparatus which is cost effective and supports efficient dispersion of the fire extinguishing fluid.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the invention.

DETAILED DESCRIPTION OF THE INVENTION

Figure 1:
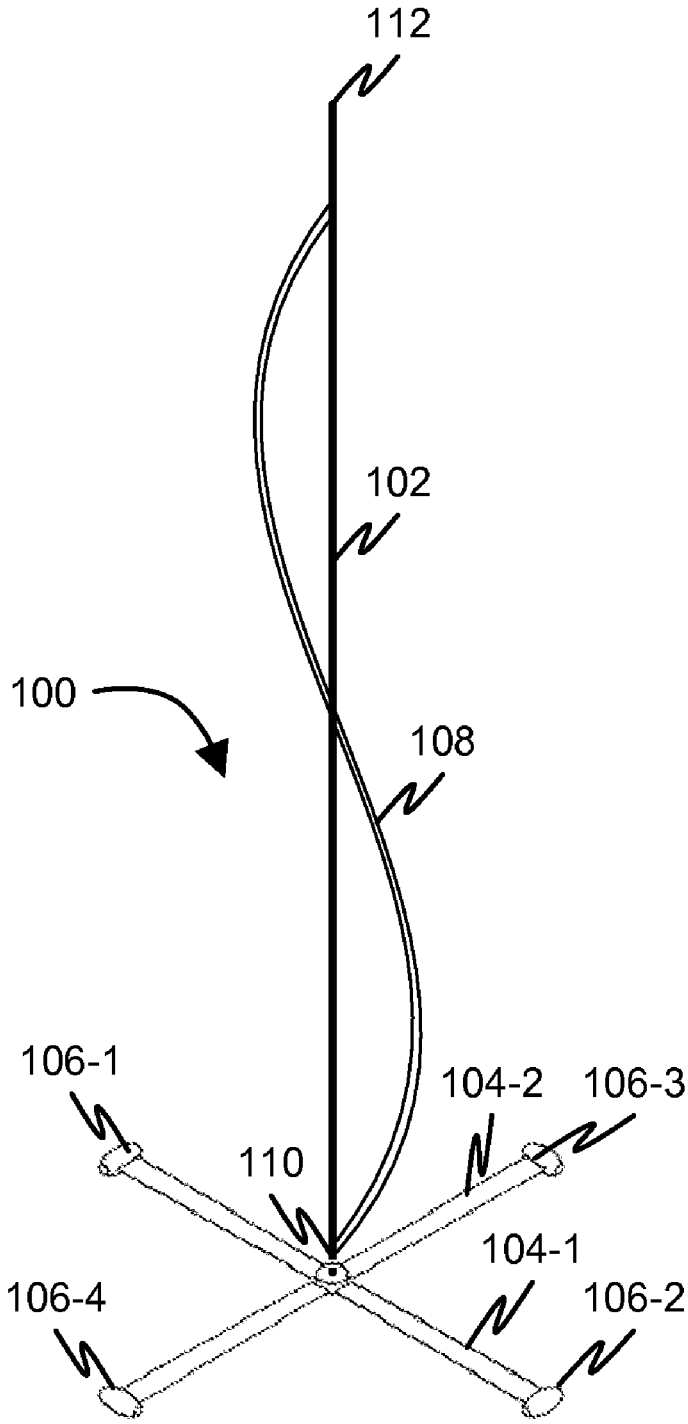
FIG. 1 illustrates a fire extinguishing apparatus in accordance with an embodiment of the invention.

Before describing in detail embodiments that are in accordance with the invention, it should be observed that the embodiments reside primarily in apparatus components related to a fire extinguishing apparatus. Accordingly, the apparatus components have been represented where appropriate by conventional symbols in the drawings, showing only those specific details that are pertinent to understanding the embodiments of the invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions.

Various embodiments of the invention provide a fire extinguishing apparatus. The fire extinguishing apparatus includes a holding unit for holding various components of the fire extinguishing apparatus. The fire extinguishing apparatus also includes one or more tubes which are operatively coupled to the holding unit. The one or more tubes are capable of rotating with respect to the holding unit, such that an axis of rotation of a tube is angled at a predetermined angle to the earth surface. Further, each tube of the one or more tubes includes one or more nozzles for dispersing a fire extinguishing fluid to a location of the fire. The fire extinguishing fluid is supplied to the one or more tubes through a fluid supplying unit. The fluid supplying unit and the one or more tubes are held together by the holding unit in a suspended manner above the location of the fire.

FIG. 1 illustrates a fire extinguishing apparatus 100 in accordance with an embodiment of the invention. Fire extinguishing apparatus 100 includes a holding unit 102, one or more tubes 104-*n* and a fluid supplying unit 108. Holding unit 102 holds various components of fire extinguishing apparatus 100, such as one or more tubes 104-*n* and fluid supplying unit 108. Examples of holding unit 102 include, but are not limited to a rod, a rope, a ring, a hook, a grid, a pipe, a star shaped holding structure, a bar, a pole, a cord, and a cable. Further, various materials may be utilized for constructing holding unit 102, such as metal, non-metal, plastic, polymer, fabric, and so forth.

Holding unit 102 holds one or more tubes 104-*n*, such as a tube 104-1 and a tube 104-2. One or more tubes 104-*n* are used for spreading a fire extinguishing fluid around a location of the fire. Examples of the fire extinguishing liquid may include, but are not limited to water, $CO_2$, inert gas, and other pressurized fire extinguishing fluids known in the art. The fire extinguishing fluid is supplied to one or more tubes 104-*n* by fluid supplying unit 108. Each tube of one or more tubes 104-*n* may be a hollow tube which enables passage of the fire extinguishing fluid through the tube. Further, each tube may be a rigid tube or a flexible tube. One or more tubes 104-*n* may be composed of materials, such as but not limited to, metals, alloys, non-metal, ceramics, and plastics. In an embodiment, one or more tubes 104-*n* may be composed of a heat conductive material, such as titanium and stainless steel. In addition, one or more tubes 104-*n* may have different shapes, such as but not limited to a straight tube, an airfoil tube, and an S shaped tube.

One or more tubes 104-*n* are capable of rotating with respect to holding unit 102. Each tube of one or more tubes 104-*n* may be operatively coupled to holding unit 102. Each tube may be coupled to an end of holding unit 102. For example, tube 104-1 and tubes 104-1 are coupled to a first end 110 of holding unit 102. It will be apparent to a person skilled in art, that various known coupling mechanisms may be used for coupling each tube with first end 110 of holding unit 102. Each tube of one or more tubes 104-*n* may rotate with respect to a point on holding unit 102. The point refers to a position where one or more tubes 104-*n* are coupled to holding unit 102. Therefore, an axis of rotation of each tube passes through the point on holding unit 102. The axis of rotation of a tube of one or more tubes 104-*n* may be angled at a predetermined angle with respect to the earth surface. For example, the predetermined angle may be 90 deg. In this case, a center of a tube may be coupled to a point on holding unit 102. The center of the tube is a midpoint along the length of the tube. Further, the axis of rotation of the tube passing through the point of coupling is perpendicular to the length of the tube. Each tube may be coupled to the point such that the tube is parallel to earth surface. Alternatively, each tube may become parallel to the earth surface upon rotating. In this case, each tube may be loosely coupled to holding unit 102. Thus, when each tube rotates, then these tubes may be aligned parallel to the earth surface.

In an embodiment, each tube of one or more tubes 104-*n* may be coupled to holding unit 102 at one point such as to form a cross arrangement as shown in FIG. 1. For example, tube 104-1 and tube 104-2 are coupled together to holding unit 102 at one point to from the cross arrangement. The cross arrangement is achieved by coupling tube 104-1 and tube 104-2 to the point on holding unit 102 at their centers. The center of tube 104-1 is a midpoint along length of tube 104-1 and the center of tube 104-2 is a midpoint along length of tube 104-2. Similar arrangements may be formed by coupling one or more tubes 104-*n* to holding unit 102, such as, but not limited to a star arrangement, a triangle arrangement, a square arrangement, and a circular arrangement. To form these arrangements of one or more tubes 104-*n*, each tube of one or more tubes 104-*n* may be fixed to one another using a fixing mechanism known in the art, for example by using one or more jointers. Further, such arrangements of one or more tubes 104-*n* enable efficient rotation of one or more tubes 104-*n* with respect to holding unit 102.

Rotation of one or more tubes 104-*n* is induced by a propelling force applied by one or more nozzles 106-*n* due to dispersion of the fire extinguishing fluid from one or more nozzles 106-*n*. A nozzle of one or more nozzles 106-*n* may be an expansion nozzle which increases speed of fire extinguishing fluid at exit by reducing pressure of the fire extinguishing fluid. The nozzle may include but are not limited to, a supersonic nozzle and a subsonic nozzle. One or more nozzles 106-*n* are included in one or more tubes 104-*n* to disperse the fire extinguishing fluid at the location of the fire. For example, nozzle 106-1 and nozzle 106-2 are included in tube 104-1. The fire extinguishing fluid dispersed from nozzle 106-1 and nozzle 106-2 enables tube 104-1 to rotate. One of ordinary skill in the art will recognize that nozzles with different shapes and sizes known in the art may be used as one or more nozzles 106-*n*. Each nozzle of one or more nozzles 106-*n* imparts kinetic energy to the fire extinguishing fluid passing through one or more tubes 104-*n*. Therefore, the fire extinguishing fluid is ejected from each nozzle with a high pressure and a propelling force is applied on one or more tubes 104-*n* due to ejection of the fire extinguishing fluid. As a result, rotation is induced in one or more tubes 104-*n*. A direction of rotation of a tube is based on the propelling force applied on the tube. For example, as shown in FIG. 1, a direction of rotation of tube 104-1 and tube 104-2 may be counter clockwise.

In order to induce rotation efficiently in a tube, a nozzle of one or more nozzles 106-*n* may be positioned at each end of a tube. Further, a center of the tube is coupled to a point of holding unit 102, the center being midpoint of the tube along length of the tube. In an embodiment, equal number of nozzles may be provided on a left side of the center of the tube and a right side of the center of the tube. As equal number of nozzles is provided on both sides of the center of the tube, the tube may rotate in an efficient manner. It would be apparent to a person skilled in art that any number of one or more nozzles may be included in a tube along the length of the tube for inducing rotation in the tube.

In an embodiment, efficient rotation of one or more tubes 104-*n* may also be achieved when a heat conductive material may be used for manufacturing one or more tubes 104-*n*. The heat conductive material facilitates in heating the fire extinguishing fluid held in one or more tubes 104-*n*. As a result, the fire extinguishing fluid may change its state to form a gaseous state. For example, water used as the fire extinguishing fluid may change its state to form steam. Thus, when the fire extinguishing fluid is ejected from one or more nozzles 106-*n* in a gaseous state, an increased propelling force may be experienced in one or more tubes 104-*n*. Therefore, one or more tubes 104-*n* may rotate faster.

Apart from holding unit 102 and one or more tubes 104-*n*, fire extinguishing apparatus 100 also includes fluid supplying unit 108 for supplying the fire extinguishing fluid to one or more tubes 104-*n*. In an embodiment, fluid supplying unit 108 may include one or more hose pipes for providing the fire extinguishing fluid. The one or more hose pipes are connected to one or more tubes 104-*n*. It will be apparent to a person skilled in art that any of the fixing mechanisms known in the art may be utilized for fixing the one or more hose pipes with one or more tubes 104-*n*. For example, jointers may be used for fixing the one or more hose pipes with one or more tubes 104-*n*. In an embodiment, a single hose pipe is utilized for providing the fire extinguishing fluid to all tubes of one or more tubes 104-*n*. In another embodiment, a plurality of hose pipes may be used for providing the fire extinguishing fluid to one or more tubes 104-*n*.

Fluid supplying unit 108 may further include a pump (not shown in FIG. 1) for pumping the fire extinguishing fluid to the one or more hose pipes. Fluid supplying unit 108 is capable of supplying various types of fire extinguishing fluids, such as water, $CO_2$, and inert gases.

In various embodiments of the invention, one or more tubes 104-*n* and fluid supplying unit 108 are held together by holding unit 102 in a suspended manner above the location of the fire. This is accomplished by connecting a top end of holding unit 102 with a vehicle or an aircraft and suspending apparatus 100 above the location of the fire. For example, a second end 112 of holding unit 102 may be connected to a helicopter or a crane. It will be apparent to a person skilled in art that holding unit 102 may connected with a vehicle or an aircraft using any known connecting means, such as a rope, a cable, a hook, and a rod.

Suspension of fire extinguishing apparatus 100 above the location of the fire enables aerial dispersion of the fire extinguishing fluid directly above the location of the fire. Thus, the fire extinguishing fluid may be supplied across a large area of the location of the fire as one or more tubes 104-*n* disperse the fire extinguishing fluid while rotating. Further, ejection of the fire extinguishing fluid from one or more nozzles 106-*n* at a high pressure enables suppression of the fire.

In an embodiment, fire extinguishing apparatus 100 may be held close to the fire, such that rotational motion of one or more tubes 104-*n* generates a propelling effect to create a difference in a pressure value between the air below and above one or more tubes 104-*n* that are rotating. The propelling effect results in creation of a high pressure zone below one or more tubes 104-*n* and a low pressure zone above one or more tubes 104-*n*. Therefore, a suppression force is applied on flames of the fire in a downward direction by dispersion of the fire extinguishing fluid on the fire. Further, fumes of the fire are released in upward direction in the air from the high pressure zone to the low pressure zone. As a result, fire extinguishing apparatus 100 facilitates in retarding the fire in an efficient manner. Further, a vehicle or an aircraft which is utilized for suspending apparatus 100 is protected from the flames of the fire.

Figure 2:
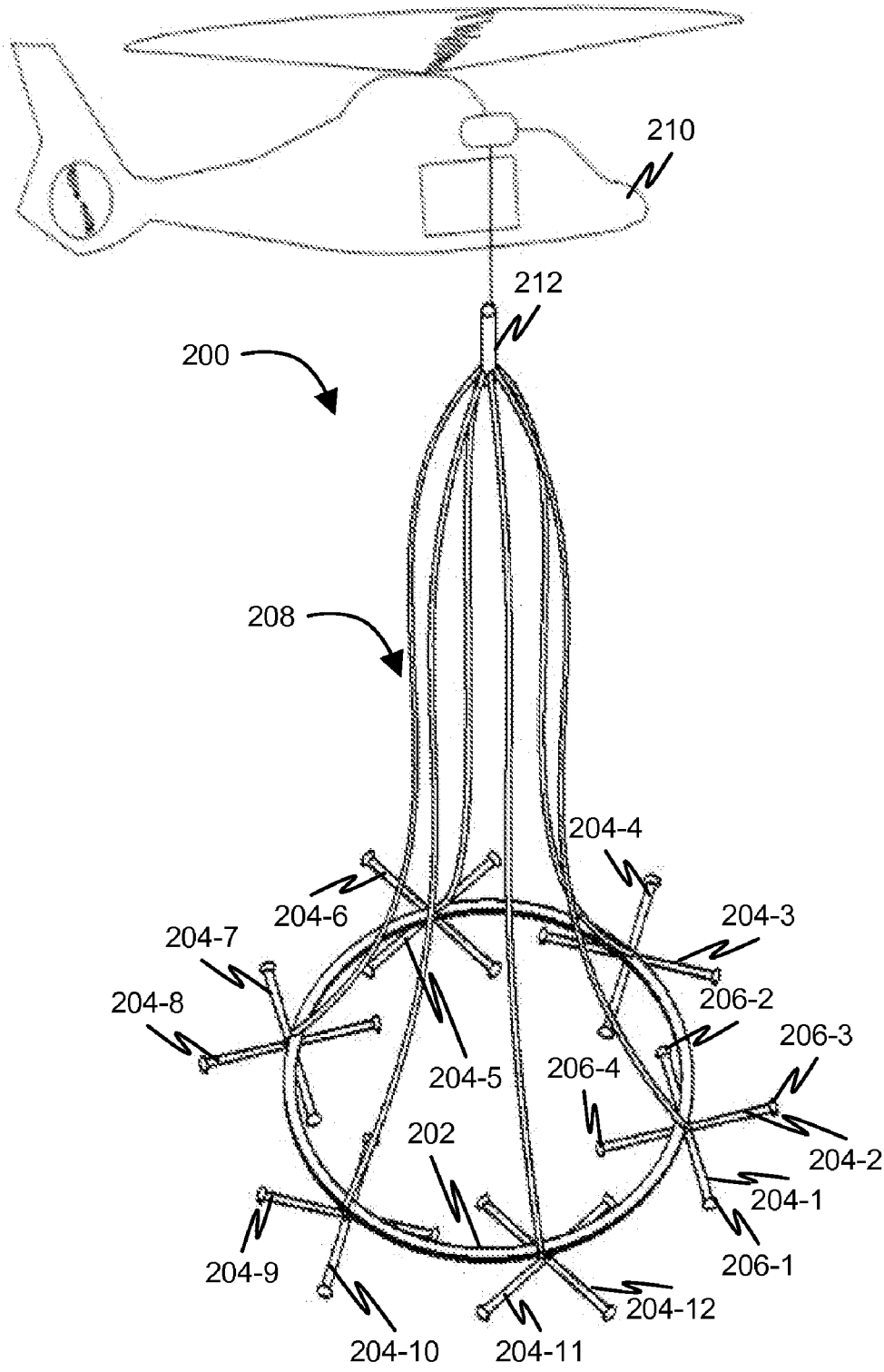
FIG. 2 illustrates a fire extinguishing apparatus in accordance with another embodiment of the invention.

FIG. 2 illustrates a fire extinguishing apparatus 200 in accordance with another embodiment of the invention. Fire extinguishing apparatus 200 includes a holding unit 202, a plurality of tubes 204-*n* and a fluid supplying unit 208. Further, apparatus 200 is suspended above a location of fire by utilizing a helicopter 210.

Holding unit 202 is a ring which holds various components of apparatus 200, such as plurality of tubes 204-*n* and fluid supplying unit 208. Various materials may be utilized for constructing holding unit 202, such as but not limited to, metal, non-metal, plastic, polymer, fabric, and so forth.

Holding unit 202 holds plurality of tubes 204-*n*, such as a tube 204-1 and a tube 204-2. Plurality of tubes 104-*n* are used for spreading a fire extinguishing fluid around a location of the fire. Examples of the fire extinguishing liquid may include, but are not limited to water, $CO_2$, and inert gas. The fire extinguishing fluid is supplied to plurality of tubes 204-*n* by fluid supplying unit 208. Each tube of plurality of tubes 204-*n* is a hollow tube which enables passage of the fire extinguishing fluid through the tube. Further, each tube may be a rigid tube or a flexible tube. Plurality of tubes 204-*n* may be composed of materials, such as metals, alloys, non-metal, ceramics, and plastics. In a specific embodiment, plurality of tubes 204-*n* may be composed of a heat conductive material, such as titanium and stainless steel. In addition, plurality of tubes 204-*n* may have different shapes, such as but not limited to a straight tube, an airfoil tube, and an S shaped tube.

Holding unit 202 holds plurality of tubes 204-*n*, such that one or more tubes of plurality of tubes 204-*n* are coupled at a point on holding unit 202. For example, a tube 204-1 and a tube 204-2 are coupled at a point of holding unit 202. Similarly, a tube 204-3 and a tube 204-4 are coupled at another point of holding unit 202. Plurality of points on holding unit 202 which are coupled to plurality of tubes 204-*n* may be equidistant from each other. Further, all tubes coupled together at one point on holding unit 202 may form an arrangement together. For example, as shown in FIG. 2, tube 204-1 and tube 204-2 form a cross arrangement at a point of coupling on holding unit 202. Similarly, tube 204-3 and tube 204-4 also form a cross arrangement at another point of coupling on holding unit 202. It will be apparent to a person skilled in art, that various known coupling mechanisms may be used for coupling each tube a point on holding unit 202.

As explained before in conjunction with FIG. 1 corresponding to one or more tubes 104-*n*, each tube of plurality of tubes 204-*n* is capable of rotating with respect to holding unit 202. Rotation of each tube of the plurality of tubes 204-*n* may be performed with respect to a point on holding unit 202 coupled to the tube. Therefore, an axis of rotation of a tube passes through a point of holding unit 202 at which the tube is coupled to holding unit 202. Further, each tube is coupled to the point on holding unit 202 from a center of the tube, thereby obtaining an axis of rotation which is angled at 90 deg. with the earth surface. Also the axis of rotation of the tube is perpendicular to the length of the tube. Each tube may be coupled to the point such that the tube is parallel to earth surface. Alternatively, each tube may become parallel to the earth surface due to rotation.

Rotation of each tube of plurality of tubes 204-*n* is induced by a propelling force applied by plurality of nozzles 206-*n* due to dispersion of the fire extinguishing fluid from plurality of nozzles 206-*n*. For example, rotation of tube 204-1 may be induced by a nozzle 206-1 and a nozzle 204-*n*. Plurality of nozzles 206-*n* are included in plurality of tubes 204-*n* to provide dispersion of the fire extinguishing fluid at the location of the fire. Each nozzle of plurality of nozzles 206-*n* imparts kinetic energy to the fire extinguishing fluid passing through plurality of tubes 204-*n*. Therefore, the fire extinguishing fluid is ejected from each nozzle with a high pressure and a propelling force is applied on plurality of tubes 104-*n* due to ejection of the fire extinguishing fluid. As a result, rotation is induced in plurality of tubes 104-*n*.

In order to perform rotation of plurality of tubes 204-*n* efficiently, one nozzle is positioned at each end of a tube of plurality of tubes 204-*n*. Further, a heat conductive material may be used for composing plurality of tubes 204-*n* in order to facilitate change of state of the fire extinguishing fluid into gaseous state. Thus, when the fire extinguishing fluid is ejected from plurality of nozzles 206-*n* in gaseous state, an increased propelling force may be experienced by plurality of tubes 204-*n*. Therefore, plurality of tubes 204-*n* may rotate faster.

Apart from holding unit 202 and plurality of tubes 204-*n*, fire extinguishing apparatus 200 also includes fluid supplying unit 208 for supplying the fire extinguishing fluid to one or more tubes 204-*n*. Fluid supplying unit 208 includes a plurality of hose pipes for providing the fire extinguishing fluid to plurality of tubes 204-*n*. For example, one hose pipe may be used for supplying the fire extinguishing fluid to one or more tubes of plurality of tubes 204-*n* held together at a point on holding unit 202. Fluid supplying unit 208 may further include a pump (not shown in FIG. 2) for pumping the fire extinguishing fluid to the plurality of hose pipes.

In various embodiments of the invention, plurality of tubes 204-*n* and fluid supplying unit 208 are held together by holding unit 202 in a suspended manner above the location of the fire. This is accomplished by connecting a top end of holding unit 202 with an aircraft, such as helicopter 210 and suspending apparatus 200 above the location of the fire. In an embodiment, plurality of hose pipes may be used for suspending holding unit 202 and plurality of tubes 204-*n* with the aircraft. For example, as shown in FIG. 2, a connecting unit 212 is connected to each hose pipe of the plurality of hose pipes and is coupled to helicopter 210 as well. Connecting unit 212 suspends the plurality of hose pipes with helicopter 210. As a result, the plurality of hose pipes which are coupled to holding unit 202 and plurality of tubes 204-*n*, hold holding unit 202 and plurality of tubes 204-*n* in a suspended manner above the location of the fire. Connecting unit 212 may also supply the fire extinguishing fluid provided by a pump to the plurality of hose pipes.

In another embodiment, a suspending unit may be included in holding unit 202 (not shown in FIG. 2) for suspending holding unit 202 and plurality of tubes 204-*n* with the aircraft. For example, suspending unit may be a rod which is connected at a first end to holding unit 202 and the aircraft at a second end which is opposite to the first end. Further, the rod may be capable of transferring the fire extinguishing fluid to plurality of tubes 204-*n*.

Suspension of fire extinguishing apparatus 200 above the location of the fire enables aerial dispersion of the fire extinguishing fluid directly above the location of the fire. Thus, the fire extinguishing fluid may be supplied across a large area of the location of the fire as plurality of tubes 204-*n* disperse the fire extinguishing fluid while rotating. Further, ejection of the fire extinguishing fluid from plurality of nozzles 206-*n* at a high pressure enables suppression of the fire.

In an embodiment, fire extinguishing apparatus 200 may be held close to the fire, such that rotation motion of plurality of tubes 204-*n* generates a propelling effect to create a difference in a pressure value between the air below and above plurality of tubes 204-*n* that are rotating. The propelling effect results in creation of a high pressure zone below plurality of tubes 104-*n* and a low pressure zone above one or more tubes 104-*n*. Further, ring structure of holding unit 202 enables in forming an umbrella of the high pressure zone above the location of the fire. Within the umbrella of the high pressure zone, a suppression force is applied on flames of the fire in downward direction by dispersion of the fire extinguishing fluid on the fire. Further, fumes of the fire are released in upward direction in the air from this high pressure zone to the low pressure zone. As a result, fire extinguishing apparatus 200 facilitates retarding the fire in an efficient manner. Further, the aircraft which is utilized for suspending apparatus 200 is protected from the flames of the fire.

Various embodiments of the invention provide an apparatus for efficiently extinguishing fire in large areas. The apparatus enables aerial distribution of the fire extinguishing fluid above a location of the fire by suspending the apparatus above the location of the fire. Further, the fire extinguishing liquid is distributed across large areas by utilizing rotating tubes with nozzles for dispersing the fire extinguishing fluid. The rotation motion of the tubes also provides a propelling effect to enable suppression of flames of the fire and release of fumes of the fire. Therefore, the apparatus facilitates retarding the fire in an efficient manner. Further, any means used for suspending the apparatus above the location of the fire is protected from the flames of the fire. The apparatus utilizes a simple mechanism and minimum man power for handling the apparatus. Thus, the apparatus enables combating fire spread across large areas in a cost effective manner. The apparatus may be used for extinguishing forest fire and brush fire.

Those skilled in the art will realize that the above recognized advantages and other advantages described herein are merely exemplary and are not meant to be a complete rendering of all of the advantages of the various embodiments of the present invention.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The present invention is defined solely by the appended claims including any amendments made during the pendency of this application and all equivalents of those claims as issued.

What is claimed is:

1. An apparatus for extinguishing fire, the apparatus comprising:

a holding unit;

multiple tubes operatively connected to the holding unit, the multiple tubes balanced around an axis of rotation and forming arms capable of rotating as a unit with respect to the holding unit, at least one nozzle per tube for dispersing a fire extinguishing fluid to a location of fire and for propelling rotation of the arms;

a fluid supplying line for supplying the fire extinguishing fluid to the rotating arms, wherein a first end of the holding unit holds the rotating arms and the fluid supplying line connects with a fluid supply at a second end of the holding unit in a suspended manner above the location of fire; and wherein the rotating arms create a pressure differential to protect an aircraft from flames of the fire.

2. The apparatus of claim 1, wherein the arms rotate in response to a propelling force exerted by the dispersion of the fire extinguishing fluid from the at least one nozzle.

3. The apparatus of claim 1, wherein the arms are operatively coupled to the holding unit from a center of each tube, wherein the center is a midpoint along length of the tube.

4. The apparatus of claim 1, wherein the arms are hollow.

5. The apparatus of claim 1, wherein the arms are one of a rigid tube and a flexible tube.

6. The apparatus of claim 1, wherein the arms are shaped as one of a straight tube, an airfoil tube, and an S shaped tube.

7. The apparatus of claim 1, wherein the arms are composed of one of a metal, a non-metal, and a plastic material.

8. The apparatus of claim 1, wherein each nozzle is positioned at an end of a tube.

9. The apparatus of claim 1, wherein the pressure differential being a difference in a pressure value of the air created in response to the rotation of the arms thereby further suppressing flames of the fire in a downward direction and releasing fumes of the fire in an upward direction in the air.

10. The apparatus of claim 9, wherein a pressure value of the air below each tube is higher than a pressure value of the air above each tube.

11. The apparatus of claim 1, wherein the fluid supply comprises:

at least one hose pipe for supplying the fire extinguishing fluid to the arms, wherein each hose pipe is connected to one of the multiple tubes; and a pump for pumping the fire extinguishing fluid to each hose pipe.

12. The apparatus of claim 11, wherein the at least one hose pipe suspends the holding unit in air in a vertical manner above the location of the fire.

13. The apparatus of claim 1, wherein the holding unit comprises a ring, wherein the ring is operatively coupled to the arms.

14. The apparatus of claim 13, wherein the holding unit further comprises a suspending unit for suspending the ring and the fluid supply in a vertical manner above the location of the fire.

15. The apparatus of claim 14, wherein the suspending unit is held in air by one of a helicopter, and a crane, thereby enabling the apparatus to be positioned above the location of fire.

16. The apparatus of claim 13, wherein the ring is a hollow tube, wherein the fluid supplying unit is connected to the ring and supplies the fire extinguishing fluid to the arms through the ring.

17. The apparatus of claim 13, wherein the arms are coupled to the ring from a center of each tube, wherein the center is a midpoint along the length of the tube.

18. The apparatus of claim 13, wherein each tube is positioned on the ring at an equal distance.

19. The apparatus of claim 1, wherein the fire extinguishing fluid is one of water, steam, and CO2.

* * * * *